United States Patent [19]

Mabboux et al.

[11] Patent Number: 5,033,213

[45] Date of Patent: Jul. 23, 1991

[54] WEARING APPAREL HAVING AN ENERGY CONSUMING DEVICE

[75] Inventors: Michel Mabboux, Seynod; Jean-Louis DeMarchi, Duingt, both of France

[73] Assignee: Salomon S. A., Cedex, France

[21] Appl. No.: 432,891

[22] Filed: Nov. 7, 1989

Related U.S. Application Data

[63] Continuation-in-part of Ser. No. 409,457, Sep. 19, 1989.

[30] Foreign Application Priority Data

Sep. 19, 1988 [FR] France ..... 88 12197
Nov. 8, 1988 [FR] France ..... 88 14553

[51] Int. Cl.[5] ..... A43B 7/02

[52] U.S. Cl. ..... 36/2.6; 36/117; 36/120

[58] Field of Search ..... 36/2.6, 50, 117, 137, 36/139

[56] References Cited

U.S. PATENT DOCUMENTS

| | | | |
|---|---|---|---|
| 3,663,796 | 5/1972 | Hines et al. | 219/211 |
| 3,977,093 | 8/1976 | Santroch | 36/2.6 |
| 4,180,922 | 1/1980 | Cieslak et al. | 36/2.6 |
| 4,646,350 | 2/1987 | Batra | 36/139 X |
| 4,736,530 | 4/1988 | Lakic et al. | 36/2.6 |
| 4,771,556 | 9/1988 | Kim | 36/50 X |
| 4,780,968 | 11/1988 | Bragagnolo | 36/2.6 |

FOREIGN PATENT DOCUMENTS

| | | | |
|---|---|---|---|
| 0146792 | 7/1985 | European Pat. Off. . | |
| 2080146 | 10/1971 | France . | |
| 1136269 | 1/1980 | Italy . | |
| 196850 | 2/1984 | Italy . | |
| 1223883 | 4/1986 | U.S.S.R. | 36/2.6 |
| 8605663 | 10/1986 | World Int. Prop. O. . | |

OTHER PUBLICATIONS

Copy of French Search Report for French Application No. 88.12197.

Copy of French Search Report for French Application No. 88.14553.

*Primary Examiner*—Jimmy G. Foster
*Assistant Examiner*—BethAnne C. Cicconi
*Attorney, Agent, or Firm*—Sandler, Greenblum & Bernstein

[57] ABSTRACT

An item of wearing apparel, such as a ski shoe or boot, provided with an energy source and an energy consuming device, such as a heater, and a mechanism for automatically terminating the energy supply as soon as the wearer removes the item of apparel. More specifically, the ski shoe or boot includes a shell base on which is journalled at least one movable upper element, such as a rear spoiler or a front cuff, to permit insertion and removal of the boot, wherein the boot includes a device controlling the energy supply of the consuming device. The boot further includes a linkage device between the movable upper element and the device controlling the energy supply so as to allow the energy supply of the consuming device only when the movable element of the boot is closed and to automatically cause the fuel supply to be shut off as soon as the movable element of the boot is moved toward the open position.

34 Claims, 3 Drawing Sheets

26c
22
2a
24
III
26b
14
23
19
25
2
32
33
34
26
36
37
26a
33
15
17
16
26d
18
26e
35
27
28
2c
28b
2b
3
28c
28d
8
1b
1a
11

26c
21
14
26b
22
2a
2
19
24
32
26
I
26a
34
23
34
25
17
33
36
16
33
18
37
35
26d
26e
28
27
28b
28a
28c
2c
28d
2b
3
1b
1a
11

II
2a
2
28
28a
2c
28e
28b
28f
2b
3
28c
1a
1

2
28a
28
28e
1
1a
28c
3
28f
1c
39

WEARING APPAREL HAVING AN ENERGY CONSUMING DEVICE

This application is a continuation-in-part of application Ser. No. 07/409,457, filed on Sep. 19, 1989, the subject matter of which is hereby incorporated by reference.

BACKGROUND OF THE INVENTION

1. Field of the Invention

The present invention relates to a downhill or cross-country ski shoe or boot having a shell base on which at least one upper element is journalled for movement, such a rear or front spoiler, for permitting the skier to put on and take off the shoe or boot, wherein the shoe or boot includes an energy source, an energy consuming device, such as a heating device, and an apparatus for controlling the energy supply for the energy consuming device.

2. Description of Background Information

Ski shoes or boots are known which are intended to improve the comfort of the wearer by means of the incorporation of heating devices. These devices include the electric type, which use a heating resistance, and the liquid or gaseous fuel type, which use a reservoir of fuel and a burner positioned in the shoe or boot. The heating devices having liquid or gaseous fuel are advantageous, compared to electric devices, in making it possible to obtain a greater autonomy, making them more convenient, and to ensure, during a relatively long period of time, a desired level of comfort of the shoe or boot with regard to the temperature.

Heating devices using a liquid fuel, such as those described, for example, in Italian Patent No. 1,136,269 and French Patent No. 2,080,146, generally comprise a burner having rechargeable liquid fuel, which is positioned under a heat diffusion plate incorporated into the sole of the shoe or boot so as to extend as close as possible to the foot of the wearer of the shoe or boot. Other heating devices which use a gaseous furl comprise a reservoir of gas which feed, through a valve, a catalytic burner, all of these elements being likewise totally positioned within the sole of the shoe or boot.

Such heating devices having gaseous fuel are described, for example, in Italian Design No. 196,850 and in International Patent Application WO 86/05663. Heating devices using gaseous fuel are of the type having a rechargeable gas reservoir and it is consequently necessary to provide, in the sole of the shoe or boot which contains the reservoir, an orifice through which the internal gas reservoir can be connected to an external recharging source of external gas.

All the known heating devices, either of the electric type or of the type using liquid or gaseous fuel, have the disadvantage that once heating is started, stopping the heating can only be obtained through manual intervention by the wearer of the boot. Otherwise stated, the wearer of the boot must think of cutting off the heating when he takes off his boot and, consequently, it is obviously possible for him or her to forget to perform this operation, which then translates into a continuation of the heating of the removed boot, thus a rapid exhaustion of the energy source used and a waste of this energy.

SUMMARY OF THE INVENTION

It is an object of the present invention to improve upon known apparatus. To this end, the present invention is directed to an item of wearing apparel having at least two portions, one of which is movable between an open position and a closed position, the item of wearing apparel further including:

(a) an energy source;

(b) an energy consuming device; and (c) means for controlling the supply of energy from the energy source to the energy consuming device including means for terminating the supply of energy from the energy source to the energy consuming device upon movement of the one of the two portions toward the open position.

According to a specific aspect of the invention, the energy consuming device includes a heating apparatus and the energy source is an interchangeable gas fuel cartridge.

According to a further specific aspect of the invention, the item of wearing apparel is a boot including a base and a relatively movable upper. The relatively movable upper could be either a front cuff or a rear spoiler.

According to a still further aspect of the invention, the energy source and the means for controlling the supply of energy from the energy source to the energy consuming device is supported by the relatively movable upper.

Still further according to the present invention, the means for controlling the supply of energy from the energy source to the energy consuming device includes a manually actuated energy supply switch movable at least between an ON position, in which the supply of energy is permitted between the energy source and the energy consuming device, and an OFF position, in which the supply of energy is terminated from the energy source, wherein the means for controlling the supply of energy from the energy source to the energy consuming device further includes means for linking movement of the movable portion of the item of wearing apparel to the energy switch, wherein movement of the movable portion of the item of wearing apparel toward the open position is effective to permit the energy switch to move to the OFF position.

According to a still further aspect of the present invention, means are provided for biasing the energy switch toward the OFF position and means for maintaining the energy switch in the ON position against the force of the means for biasing when the movable portion of the item of wearing apparel is in the closed position.

It is an additional object of the present invention to provide a downhill or cross-country ski boot of the type including a shell base on which at least one upper movable element is journalled for movement between an open position and a closed position to permit the insertion and removal of the boot, the boot including an energy source, an energy consuming device, and a means for controlling the supply of energy to the energy consuming device, wherein the boot further includes means located between the upper movable element and the means for controlling the energy supply for linking the upper movable element and the means for controlling the energy supply for allowing the supply of energy to the energy consuming device only when the movable element of the boot is positioned in the closed, or substantially closed, position and for automatically terminating the energy supply in response to the movable element of the boot being moved toward the open position.

According to a specific embodiment of the present invention, the means for controlling the energy supply is supported by the upper movable element of the boot, and wherein the linkage means between the upper movable element and the means for controlling the energy supply includes a latching hook which, in an open position, is solidly affixed to a movable element which is part of the means for controlling the energy supply and acting on an element constituting an energy supply switch, and a hooking element for the latching hook which is positioned, with respect to the latching hook, such that, when the upper movable element of the boot is in the closed position, the latching hook grips the hooking element, by maintaining the element forming the supply switch in an open position, and that movement of the upper movable element of the boot toward the open position automatically causes the freeing of the latching hook with respect to the hooking element and the passage of the supply switch into a closed position, thus causing an automatic termination of the energy supply to the energy consuming device.

According to a further aspect of the present invention, the hooking element includes a spring having an extreme part generally in the shape of a loop for engagement with the latching hook.

Still further according to the invention, the upper movable element includes, on an anterior and upper surface, a front cuff which is journalled, at its lower and anterior part, on an anterior and upper wall of the shell base about a generally horizontal and transverse axis, wherein the means for controlling the energy supply is mounted under the front cuff, while extending in a generally vertical and longitudinal plane, the latching hook extending towards the front and cooperating with an extreme rear part, in the shape of a loop, of a latching spring which includes two substantially parallel arms by which the latching spring is anchored in the wall of the shell base.

Still further, the extreme anchoring arms of the latching spring form an obtuse angle, open upwardly, with an upper part forming a loop of the latching spring for hooking of the latching hook.

A still further aspect of the invention is that the boot is of the rear-entry type, on which the upper movable element includes a rear spoiler journalled on the shell base about a lower horizontal and transverse axis, wherein the means for controlling the energy supply is supported by the rear spoiler by extending substantially vertically along the rear spoiler, the controlling means including, on a lower part, the latching hook, and wherein the latching spring is wound about an axis extending generally horizontally and transversely with respect to a lower part of the rear spoiler, the latching spring including, between an upper part forming a loop for the hooking of the latching hook and the axis about which the latching spring is wound, an intermediate part on which acts a lower inclined wall of the rear spoiler.

According to a still further aspect of the invention, the intermediate part of the latching spring which extends between the winding axis and the upper part forming a loop is constituted by two generally parallel arms extending downwardly, the two arms of the extreme upper part forming a loop, the two parallel arms constituting the intermediate part being in contact with the lower inclined wall of the rear spoiler and forming an obtuse angle open towards the front with the extreme upper part forming a hooking loop.

According to a still further aspect of the invention, the latching spring includes two parts each wound in a helix on the axis of the latching spring and the two helical parts are extended by extreme support arms.

Still further according to the invention, the axis on which are wound the helical parts of the spring is a journal axis for the rear spoiler on the shell base.

According to a still additional aspect of the . invention, each helical part of the spring wound about the journal axis of the rear spoiler ends in an extreme anchoring arm extending downwardly and immobilized in a housing provided in an upper part of the rear wall of the shell base.

According to a still additional aspect of the invention, the two helical parts of the spring which are wound on the journal axis end, respectively, in extreme arms extending upwardly and extending downwardly, the two arms being substantially coplanar and resting against the external and upper surface of the rear wall of the shell base.

According to a still further aspect of the invention, the rear spoiler is journalled on the shell base, about a lower transverse axis which is positioned in front of the rear wall of the shell base and the helical parts of the spring are wound about a transverse axis which is provided on the lower part of the rear spoiler and which is used only for the mounting of the spring.

According to a still further aspect of the invention, the spring includes two extreme arms extending, respectively, upwardly and downwardly from the helical parts, the two extreme arms resting, when the rear spoiler is closed, against an upper and rear surface of the wall of the shell base, above a hollow provided in the upper and rear surface of the wall of the shell base.

According to a still further aspect of the invention, the upper is constituted by two parts journalled on the shell base about a common transverse axis, namely, a rear spoiler and a front cuff, wherein the extreme arms which extend the helical parts of the spring wound on the axis are anchored, at their ends, in portions of the cuff near the journal axis.

According to a still further aspect of the invention, the energy consuming device is a heating device which includes a heating assembly located in an opening of an appropriate shape provided in the upper part of the sole of the boot, the heating assembly including a burner, and wherein the energy source includes an interchangeable gas fuel cartridge which is supported, as well as the means for controlling the gas supply, by the upper movable element of the boot.

BRIEF DESCRIPTION OF THE DRAWINGS

Preferred embodiments of the present invention are described below, by way of non-limiting examples, in which further objects, features, and advantages of the present invention will become apparent, with reference to the annexed drawings in which.

DETAILED DESCRIPTION OF THE PREFERRED EMBODIMENTS

Figure 1:
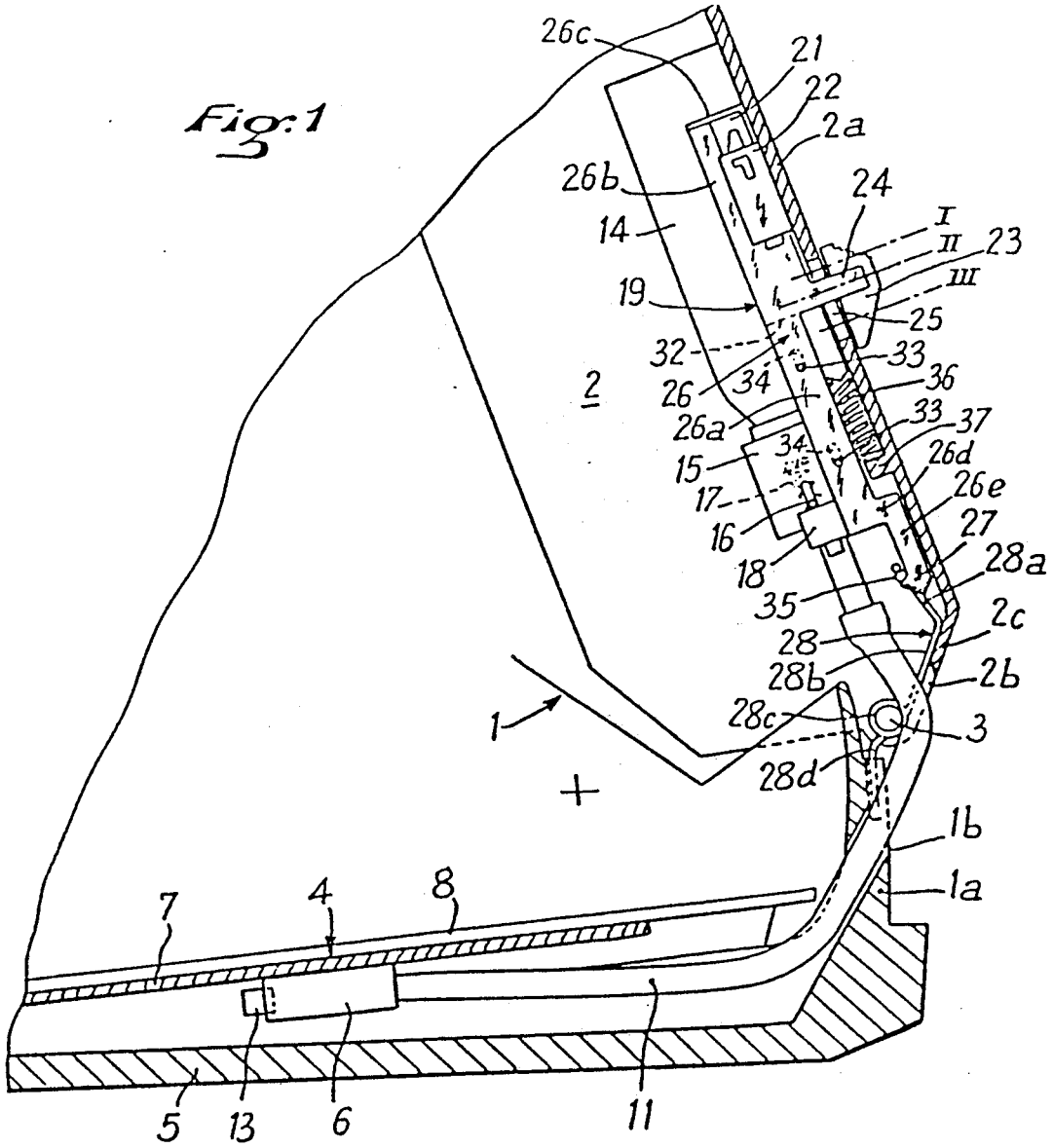
FIG. 1 is a partial vertical and longitudinal sectional view of a rear-entry downhill ski boot provided with a gas heating device, the rear spoiler being shown in the closed position and the control device for the supply of gas being shown in the open position.

As mentioned above, an object of the present invention is to remedy the disadvantages of the above-mentioned known devices by providing a shoe or boot provided with means automatically causing the cutting off of the energy supply as soon as the wearer of the boot removes the boot.

To that end, the downhill or cross-country ski boot of the present invention includes a shell base on which is journalled at least one movable upper element, such as a rear spoiler or a front cuff to permit insertion and removal of the boot, wherein the boot includes an energy source, an energy consuming device, such as a heating device, and a device controlling the energy supply of the consuming device, wherein the boot further includes a linkage means between the movable upper element and the device controlling the energy supply so as to allow the energy supply of the consuming device only when the movable element of the boot is closed and to automatically cause the fuel supply to be shut off as soon as the movable element of the boot is open.

The invention applies more particularly to a boot provided with an incorporated heating device. This heating device can be of the electric type and, in this case, the linkage means acts on an electric switch connected between an electric energy source and a heat resistance. The heating device can also be of the liquid or gaseous fuel type, in which case, the linkage means acts on a valve connected between a gas or liquid fuel tank and a burner.

The downhill ski boot according to the invention, which is shown in FIGS. 1–4, is of the rear-entry type. This boot includes a shell base 1 on which a rear spoiler 2 is journalled about a lower horizontal and transverse axis 3. This axis 3 extends slightly behind the extreme upper part of the rear wall la of the shell base 1. The boot is provided with a heating device which, in the case of the non-limiting embodiment presently described, is of the gas fuel type. However, the invention could apply in the same manner to a boot provided with an electric or liquid fuel heating device.

The heating device of the illustrated embodiment includes a heating assembly 4 which is positioned in an opening with an appropriate shape provided in the upper part of sole 5 of the boot. This heating assembly 4 includes a burner 6 affixed, for example, by welding, under a heat diffusion plate 7 itself placed under the internal sole 8 of the boot, so as to be able to heat the skier's foot in very cold weather. The burner 6 is connected to a gas supply tube 11 and the ignition of the gas is achieved by means of an electrode 13 near the burner 3 and which is part of an ignition device, for example of the piezoelectric type.

The heating assembly 4 is supplied with gas from an interchangeable gas fuel cartridge 14 which is held in a housing provided in the upper part of the rear spoiler 2 of the boot, within the latter. The gas cartridge 14 is positioned substantially vertically with its gas outlet orifice directed downwardly. In the description which follows, the direction "vertical" will be considered that according to which the rear spoiler 2 extends, whereas in fact the rear wall 2*a* of the spoiler is slightly inclined towards the front. The gas cartridge 14 is connected, at its lower end, to an assembly 15 forming a pressure-reducing control valve connected, at its lower part to the gas supply tube 11. This tube of flexible material, passes through an opening 2*b* provided in the lower transverse wall 2*c* of the spoiler 2 which is inclined from top to bottom and from rear to front and which extends in the direction of the upper part of the rear wall 1*a* of the shell base 1. Thus, the tube 11 partially extends from the spoiler 2 and it further penetrates the boot while passing through an opening 1*b* formed in the rear wall 1*a* of the shell base, to extend as far as the burner 6 lodged in the sole.

The element for control of opening and closing the valve 15 is constituted by a pin 16 projecting outside the body of valve 15 and is movable in a vertical slot of this body. The pin 16 is pushed downwardly, in the direction of its open position, by a return spring 17 lodged within the pressure-reducing valve 15. The pin 16 for control of the valve 15 is activated by a lug 18 which is part of a heating control device 19. This device 19 acts likewise on a pusher 21 of an ignitor 22, of the piezoelectric type, for example, which is connected, by an electric conductor not shown, to the electrode 13 so as to produce an ignition spark.

Figure 4:
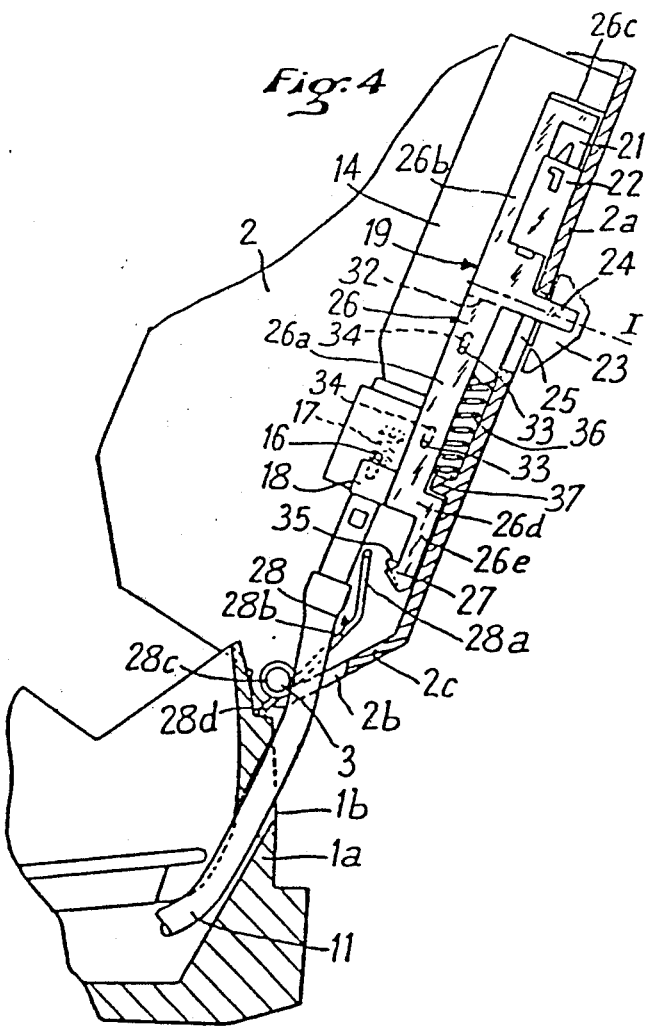
FIG. 4 is a partial vertical and longitudinal sectional view of the boot with the rear spoiler open and the device for control of gas supply returned automatically to the open position.

The heating control device includes a control knob 23 which can slide "vertically" outside of the rear wall 2*a* of spoiler 2. The control knob 23 is affixed to a lug 24 extending through a vertical slot 25 provided in the rear wall 2*a* of spoiler 2. The lug 24 constitutes the external extension of a manual release plate 26, extending vertically. This manual release plate 26 includes a vertical member 26*a* and at its upper part, a vertical wing 26*b* extended by a horizontal wing 26*c* which extends a short distance in the closed position of the gas, which is shown in FIG. 4, above the upper pusher 21 of the piezoelectric ignitor 22 affixed to spoiler 2.

The manual release plate 26 includes a lower horizontal wing 26*d* which is extended downwardly by a bar 26*e* ending in a release ramp 27 which acts on the horizontal member of the upper part 28*a*, in the shape of a loop or inverted U, of a latching spring 28. This latching spring 28 is affixed to the upper part of the rear wall la of shell base 1 of the boot. It includes, underneath its upper loop 28*a*, two parallel arms 28*b* extending downward and inclined with respect to the upper loop while forming an obtuse angle open towards the front. Each of the two arms 28*b* is connected to a helical part 28*c* of spring 28 wound around journal axis 3 of rear spoiler 2 and ending in an extreme anchoring arm 28*d* extending downward and immobilized in a housing provided in the upper part of the rear wall 1*a* of shell base 1.

The heating control device comprises moreover a second latching plate 32 which is attached to the manual release plate 26 and which has a generally C shape open towards the rear. The two plates 26 and 32 are coupled to one another by means of guide pins 33 provided on member 26*a* of the manual release plate 26, these pins 33 being engaged in slots 34 provided in the member of the other plate 32, with the slots 34 being generally aligned and elongated vertically. The lower horizontal wing of the latching plate 32 is extended downward by a bar which ends in a latching hook 35 capable of gripping under the member of the upper part 28*a* latching spring 28. Moreover, the latching plate 32 supports, on its lower part, the projecting lug 18 which activates from underneath, the pin 16 controlling the opening and closing of valve 15.

The two plates 26, 32 are biased jointly upwardly by a return spring 36 which is constituted by a compression spring 36 resting, at it lower end, on a shoulder 37 provided on the internal surface of the rear wall 2*a* of spoiler 2 and, at its upper end, both under the upper horizontal wings of plates 26 and 32. The spring 36 thus constantly biases the two plates 26, 32 upwardly and their movement in this direction is limited by the abutment of the lower wings of plates 26, 32 under the support shoulder 37.

The control knob 23 can occupy, in the slot 25, three different vertical positions, namely, an extreme upper position I, corresponding to the closing of the gas supply, an intermediate position II, corresponding to the opening of the gas supply, and an extreme lower position III, corresponding to the activation of the piezoelectric ignitor 22, these three positions I, II, III being indicated in dotted lines in FIG. 1. In the upper closed position I, the two plates 26, 32 are in the extreme upper position (FIG. 4), in which they are biased by the return spring 36, their upward movement being limited by the abutment of their lower wings against the support shoulder 37. In this position, the upper horizontal wing 26*c* of plate 26 is situated a short distance above the pusher 21 of the piezoelectric ignitor 22.

When the skier wishes to start up the heating device, he or she presses on the control knob 23 so as to displace it downwardly. In this movement, the control knob 23 moves with it the manual release plate 26 with which it is preferably unitarily formed, and the latter immediately moves in turn the latching plate 32, since the guide pins 33 which are solidly affixed with plate 26, are in contact with the lower ends of slots 34 provided in plate 32. The two plates 26, 32 are thus displaced jointly downwardly, against the action of the return spring 36. In the course of this movement, the latching hook 35 slides along the member of the upper art 28*a* of spring 28 by pushing it somewhat, after which it is placed under this member to ensure the latching. The release ramp 27 accompanies this movement naturally. At the same time, the lug 18 of plate 32 frees the control pin 16 of valve 15 so that this valve opens. Consequently, as soon as the control knob 23 reaches the intermediate position II, the valve 15 is open and the gas contained in the interchangeable cartridge 13 can then flow through the tube 11 in the direction of burner 6 of heating assembly 4.

To cause the ignition of the gas-air mixture, the skier presses down on the control knob 23 so as to bring it into its extreme lower position III. In the course of this additional descending movement, the upper horizontal wing 26*c* of plate 26, which is then in the intermediate position II, just in contact with the upper end of pusher 21, pushes the pusher downwardly and causes the activation of the piezoelectric ignitor 22, which emits an electric impulse causing an ignition spark produced by the electrode 13. In the course of this additional downward displacement, the release ramp 27 and hook 35 are slightly displaced beneath the member of the upper part 28*a* of spring 28. During the release of the control knob 23, after ignition of the gas, the two plates 26, 32 are pushed upwardly by the spring 36 until the hook 35 grips underneath the member of the upper part 28*a* of spring 28. From this moment, the two plates 26, 32 are immobilized in the intermediate open position II as is shown in FIG. 1. In this position, the lug 18 of the latching plate 32 is situated just underneath the control pin 16 of valve 15 which is itself in its extreme lower open position in a slot of the valve body.

When the skier wishes to stop the heating, he or she pulls the control knob 23 upwardly to bring it back into its extreme upper closed position I. In the course of this closing phase, the control knob 23 first causes the upward sliding of the single manual release plate 26, because of the coupling achieved by the guide pins 33 and the slots 34, these pins 33 then moving alone upwardly in slots 34 remaining immovable. Because of this displacement, the lower release ramp 27 of the voluntary release plate 26, which slides into contact with the member of the upper part 28*a* of spring 28, pushes this member progressively towards the interior, while progressively separating thus the spring until the latching hook 35 can escape therefrom. The incline of the release ramp 27 and its length are selected such that the escape of the latching hook 35 occurs before the guide pins 33 reach the upper ends of slots 34. When the latching hook 36 escapes from the spring 28, the plate 32 is freed and the two plates 26, 32 are pushed jointly upwardly, in the closed position, by spring 36. In this movement, the lug 18 of plate 32 moves with it towards the top, the pin 16 for control of valve 15, until the latter is in the closed position, at the upper end of its guide slot.

Figure 2:
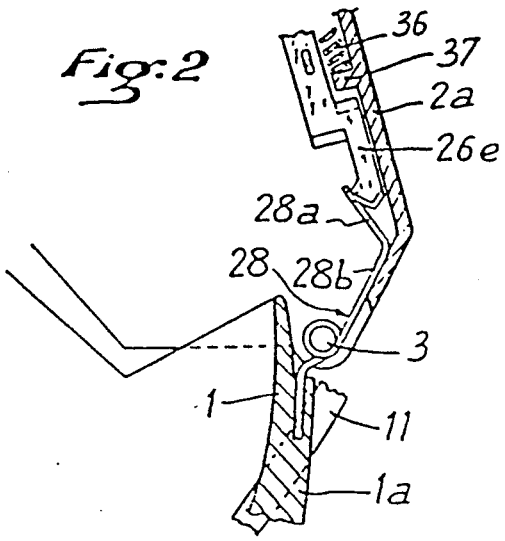
FIG. 2 is a partial vertical and longitudinal sectional view of the boot with the rear spoiler closed, the device for control of the gas supply being shown in an intermediate position, in the course of releasing, before its return to the closed position.
Figure 3:
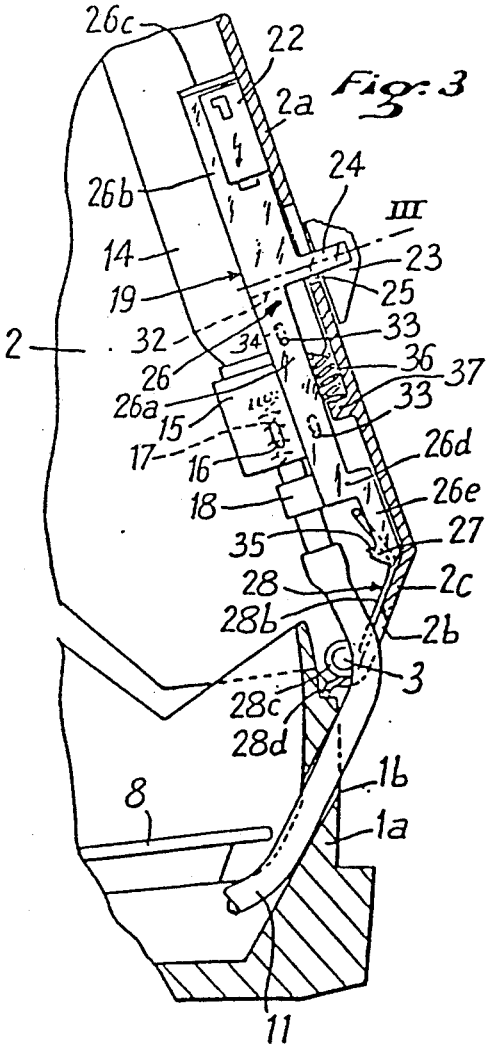
FIG. 3 is a partial longitudinal and vertical sectional view of the boot with the rear spoiler closed, the device for control of the gas supply being shown in the ignition position.

According to the invention, the boot is provided with means for automatically causing the cutting off of the gas supply as soon as the wearer of the boot removes the boot. These means are constituted, in the non-limiting embodiment shown in FIGS. 1–4, by the combination of the lower inclined wall 2*c* of the rear spoiler 2 and the latching spring 28. In fact, depending on the position occupied by the rear spoiler 2, the spring 28 is either armed or not armed in the latching position. In effect, when the rear spoiler 2 is closed, as is shown in FIGS. 1–3, its lower inclined wall 2*c* biases the spring 28 towards the front, and more particularly the arms 28*b* of this spring, by deforming it and by consequently subjecting it to an elastic prestress. In this position the upper part 28*a* of the latching spring 28, in the shape of a loop, is placed and held in a position such that it permits the hooking of the latching hook 35 of the latching plate 33.

When the skier takes off his or her boot, he or she rocks the rear spoiler 2 towards the rear, about the journal axis 3, to reach the position illustrated in FIG. 4. In the course of this movement, the lower inclined wall 2*c* of rear spoiler 2 frees the two arms 28*b* of spring 28 which can then relax and, in the course of the continuation of the rocking movement of spoiler 2 towards the rear, the latching hook 35 is separated from the upper part 28*a* of spring 28, as shown in FIG. 4. Consequently, if at the moment when the skier rocks the spoiler 2 towards the rear, the heating device is in operation, the rocking of spoiler 2 has the consequence that at a certain time in the course of this rocking movement the latching hook 35, previously hooked under the member of the upper part 28*a* of spring 28, escapes from the spring so that the two sliding plates 22, 33 are pushed upwardly by the compression spring 36. As in the case of a voluntary action, the lug 18 then pushes the pin 16 upwardly for control of valve 15 which leads to the closure thereof and the automatic cutting off of the gas supply.

When the boot is put on, the rocking of the spoiler 2 towards the front further causes a frontward bias of spring 28, under the action of the inclined wall 2*c* of spoiler 2, and the upper part 28*a* of this spring then resumes the appropriate position permitting the hooking of the latching hook 35.

Figure 5:
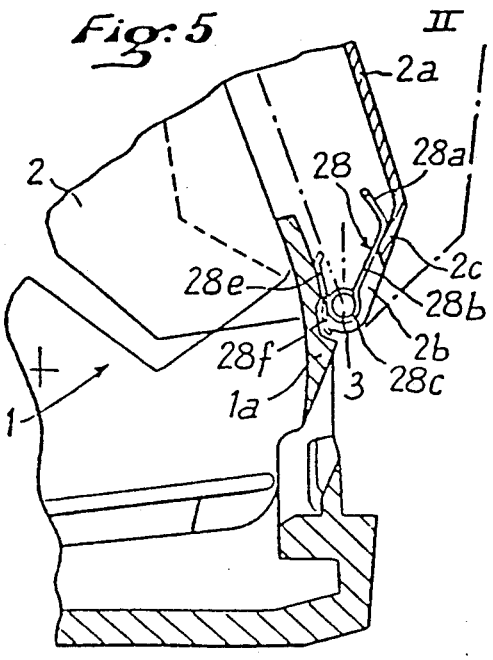
FIGS. 5 and 6 are partial longitudinal sectional views of alternative embodiments of a boot with a pivotal rear spoiler according to the invention.

In the alternative embodiment shown in FIG. 5, the two helical parts 28*c* of spring 28 which are wound on the journal axis 3 end, respectively, in extreme arm 28*e* extending upwardly and 28*f* extending downwardly, these two arms being substantially coplanar and resting against the external and upper surface of the rear wall 1*a* of the shell base 1. With regard to the remainder of the FIG. 5 embodiment, the spring 28 is embodied in the same fashion as in the case of the boot illustrated in FIGS. 1–4, the upper part 28*a* of spring 28 being biased towards the front by the lower inclined wall 2*c* of rear spoiler 2.

Figure 6:
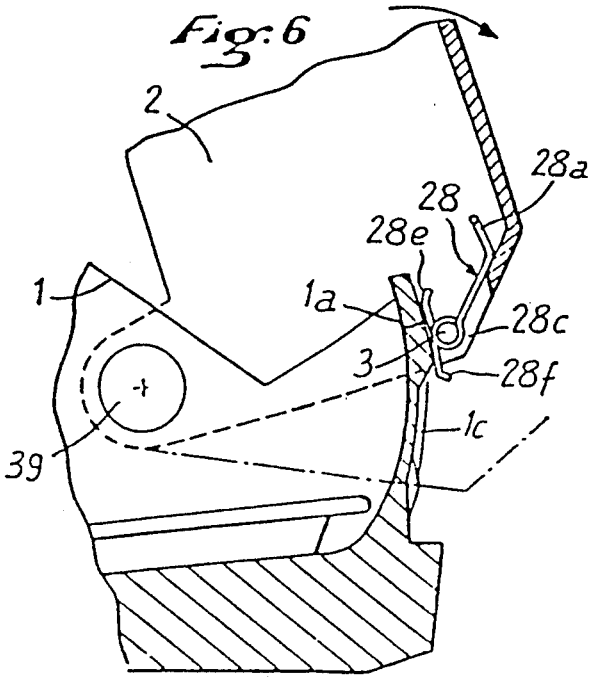

In the alternative embodiment shown in FIG. 6, the rear spoiler 2 is journalled on the shell base 1 about a lower transverse axis 39 which is situated in front of the rear wall 1*a* of shell base 1. In this case, the helical parts 28*c* of spring 28 are wound about a transverse axis 3 which is provided on the lower part of the rear spoiler 2 and which is used only for the mounting of spring 28. The spring 28 is moreover embodied in the manner illustrated in FIG. 5, i.e., it includes two extreme arms 28*e*, 28*f* extending respectively upwardly and downwardly from the helical parts 28*c*. These two extreme arms 28*e*, 28*f* rest, when the rear spoiler is closed, as is shown in FIG. 6, against the upper and rear surface of the wall la of shell base 1, above a hollow 1*c* provided in this surface while thus ensuring the maintenance of spring 28 in the armed state, under the action of the lower inclined wall 2*c* of the rear spoiler 2. When the spoiler 2 is rocked towards the rear about the transverse axis 39, the axis 3 and the spring 28 that it supports follow this movement and move progressively downwardly. At a certain time in the course of this descending movement, the two arms 28*e*, 28*f* of spring 28 arrive across from a hollow 1*c* provided in the lower part of the rear surface of the wall 1*a* of the shell base. The spring 28 is then disarmed and its upper part 28*a* is freed and can pivot freely about axis 3, by then automatically causing the release of the hook 35 and the automatic cutting off of the gas supply as in the case of the previously described embodiments.

Figure 7:
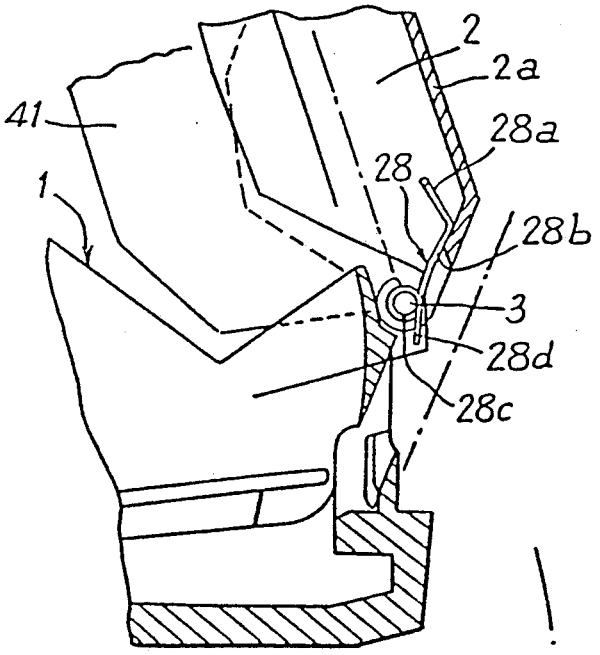
FIG. 7 is a partial longitudinal and vertical sectional view of an alternative embodiment of a boot comprising a front cuff and a rear spoiler journalled about a single axis.

In the alternative embodiment shown in FIG. 7, the boot comprises an upper constituted by two parts journalled on the shell base 1 about a common transverse axis 3, namely, the rear spoiler 2 and a front cuff 41. In this case, the extreme arms 28*d* which extend the helical parts 28*c* of spring 28 wound on axis 3, are anchored at their ends, in the parts of cuff 41 near the journal axis 3. The anchoring points of the ends of spring 28 on the cuff 41 are positioned such that this spring is armed or prestressed when the rear spoiler is in the closed position. Consequently, when the skier opens the upper of his or her boot by rocking the spoiler 2 towards the rear, the spring 28 is automatically disarmed and it then frees the latching hook 25 by thus causing the automatic cutting off of the gas supply.

Figure 8:
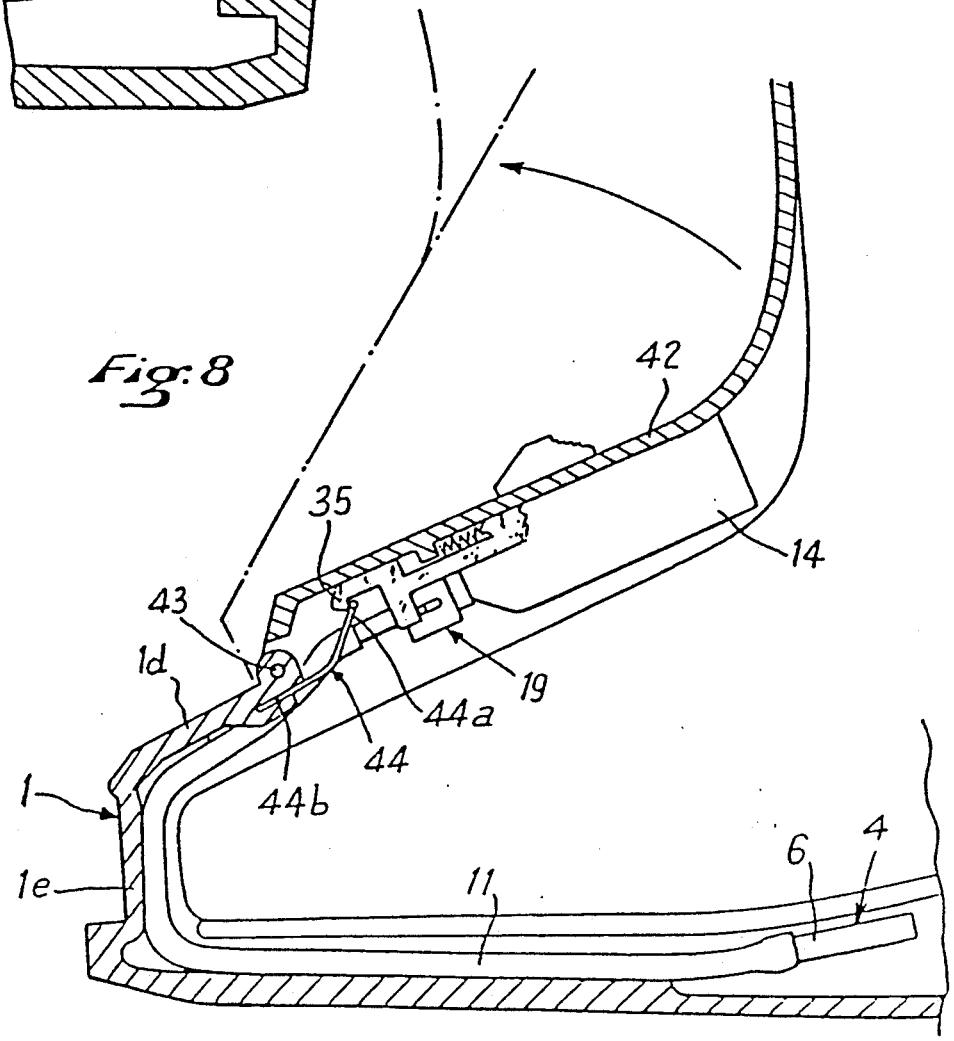
FIG. 8 is a partial longitudinal and vertical sectional view of a boot according to the invention comprising a tongue or front cuff in the form of an upper movable element.

FIG. 8 shows an alternative embodiment of the invention applied to a ski boot comprising on its front and upper surface a front cuff 42 which is journalled at its lower and front part, on a front and upper wall 1*d* of shell base 1 about a horizontal and transverse axis 43. The assembly constituted by the gas cartridge 14 and the device 19 controlling the gas supply is mounted under the front cuff 42 while extending in a generally vertical and longitudinal plane. The latching hook 35, which extends towards the front, then cooperates with the extreme rear part 44*a* in the shape of a loop, with a latching spring 44. This spring 44 includes two lower parallel arms 44*b* by which it is anchored in the wall 1*d* of the shell base 1 and which are inclined from bottom to top and from front to rear. These extreme anchoring arms 44*b* form an obtuse angle open upwardly with the upper part forming a loop 44*a* which is consequently further inclined from bottom to top and from front to rear. The latching hook 35 then grips behind the upper horizontal member of this loop-shaped part 44*a*. Because of this construction, when the skier opens his or her boot by rocking the front cuff 42 in a counterclockwise direction about the axis 43, the latching hook 35 escapes from the upper part 44*a* of spring 44, which causes, as in the previously described embodiments, the automatic cutting off of the gas supply.

It is to be noted that in the embodiment of the invention described in FIG. 8, the flexible tube 11 for gas supply extends, within the boot from the supply control device 19 downwardly and towards the front under the upper inclined wall 1*d* of shell base 1, then generally vertically along the frontal anterior wall 1*e* of the shell base, then horizontally towards the rear under the internal sole 8 to reach burner 6.

Although the invention has been described in terms of particular embodiments, comprising particular combinations of elements, materials, and functions, modifications can be made without departing from the scope of the invention defined by the following claims. For example, although the preceding description is directed to an alpine ski boot comprising, as an energy consuming device, a heating device, it is contemplated that the invention could apply likewise to any energy consuming device adapted, for example, to exert an automatic mechanical action.

Further, in the embodiment in which the heating assembly is of the electric type, in which case, a replaceable and/or rechargeable battery supply could be housed adjacent an upper of the boot which is connected to a resistance element or elements located proximate the internal sole of the boot. An electric switch could be provided in a location to be activated by the opening of the boot to disconnect the battery supply to the resistance element or elements. For example, consistent with any of the disclosed embodiments, the control knob 23 located for convenient access for the wearer of the boot on the rear of the boot, e.g., could be used to act on the aforementioned switch, in which case, the hooking of the activation plate in the lower position thereof would be effective to maintain the switch in the activated position for heating the boot. The activation and deactivation of the switch would be analogous to the opening and closing of the valve 15 by means of the lug 18 of latching plate 22 acting on the pin 16, as shown in FIG. 1.

We claim:

1. A ski boot of the type comprising a foot insertion opening and a shell base on which at least one upper movable element is journalled for movement between an open position and a closed position to permit the insertion and removal of a foot, wherein said movement directly enlarges or decreases said opening, said boot comprising an energy source, a heat providing energy consuming device, and a means for controlling a supply of energy to said energy consuming device, wherein said boot further comprises means located between said upper movable element and said means for controlling said energy supply for linking said upper movable element and said means for controlling said energy supply for allowing the supply of energy to said energy consuming device only when said movable element of said boot is positioned in said closed, or substantially closed, position and for automatically terminating said energy supply in response to said movable element of the boot being moved toward said open position.

2. The boot according to claim 1, wherein said means for controlling the energy supply is supported by said upper movable element of said boot, and wherein said linkage means between said upper movable element and said means for controlling said energy supply includes a latching hook which, in an open position, is solidly affixed to a movable element which is part of said means for controlling said energy supply and acting on an element constituting an energy supply switch, and a hooking element for said latching hook which is positioned, with respect to said latching hook, such that, when said upper movable element of said boot is in said closed position, said latching hook grips said hooking element, by maintaining said element forming said supply switch in an open position, and that movement of said upper movable element of said boot toward said open position automatically causes the freeing of said latching hook with respect to said hooking element and the passage of said supply switch into a closed position, thus causing an automatic termination of said energy supply to said energy consuming device.

3. A ski boot of the type comprising a shell base on which at least one upper movable element is journalled for movement between an open position and a closed position to permit the insertion and removal of a foot, said boot comprising an energy source, an energy consuming device, and a means for controlling a supply of energy to said energy consuming device, wherein said boot further comprises means located between said upper movable element and said means for controlling said energy supply for linking said upper movable element and said means for controlling said energy supply for allowing the supply of energy to said energy consuming device only when said movable element of said boot is positioned in said closed, or substantially closed, position and for automatically terminating said energy supply in response to said movable element of the boot being moved toward said open position, wherein said means for controlling the energy supply is supported by said upper movable element of said boot, and wherein said linkage means between said upper movable element and said means for controlling said energy supply includes a latching hook which, in an open position, is solidly affixed to a movable element which is part of said means for controlling said energy supply and acting on an element constituting an energy supply switch, and a hooking element for said latching hook which is positioned, with respect to said latching hook, such that, when said upper movable element of said boot is in said closed position, said latching hook grips said hooking element, by maintaining said element forming said supply switch in an open position, and that movement of said upper movable element of said boot toward said open position automatically causes the freeing of said latching hook with respect to said hooking element and the passage of said supply switch into a closed position, thus causing an automatic termination of said energy supply to said energy consuming device, wherein said hooking element comprises a spring having an extreme part generally in the shape of a loop for engagement with said latching hook.

4. The boot according to claim 3, wherein said upper movable element comprises, on an anterior and upper surface, a front cuff which is journalled, at its lower and anterior part, on an anterior and upper wall of said shell base about a generally horizontal and transverse axis, wherein said means for controlling said energy supply is mounted under said front cuff, while extending in a generally vertical and longitudinal plane, said latching hook extending towards the front and cooperating with an extreme rear part, in the shape of a loop, of a latching spring which includes two substantially parallel arms by which said latching spring is anchored in the wall of said shell base.

5. The boot according to claim 4, wherein said extreme anchoring arms of said latching spring form an obtuse angle, open upwardly, with an upper part forming a loop of said latching spring for hooking of said latching hook.

6. The boot according to claim 3, said boot being of the rear-entry type, on which said upper movable element comprises a rear spoiler journalled on said shell base about a lower horizontal and transverse axis, wherein said means for controlling said energy supply is supported by said rear spoiler by extending substantially vertically along said rear spoiler, said controlling means comprising, on a lower part, said latching hook, and wherein said latching spring is wound about an axis extending generally horizontally and transversely with respect to a lower part of said rear spoiler, said latching spring including, between an upper part forming a loop for the hooking of said latching hook and said axis about which said latching spring is wound, an intermediate part on which acts a lower inclined wall of said rear spoiler.

7. The boot according to claim 6, wherein said intermediate part of said latching spring which extends between said winding axis and the upper part forming a loop is constituted by two generally parallel arms extending downwardly, said two arms of the extreme upper part forming a loop, said two parallel arms constituting said intermediate part being in contact with said lower inclined wall of said rear spoiler and forming an obtuse angle open towards the front with the extreme upper part forming a hooking loop.

8. The boot according to claim 6, wherein said latching spring comprises two parts each wound in a helix on said axis of said latching spring and said two helical parts are extended by extreme support arms.

9. The boot according to claim 7, wherein said latching spring comprises two parts each wound in a helix on said axis of said latching spring and said two helical parts are extended by extreme support arms.

10. The boot according to claim 8, wherein said axis on which are wound said helical parts of said spring is a journal axis for said rear spoiler on said shell base.

11. The boot according to claim 9, wherein said axis on which are wound said helical parts of said spring is a journal axis for said rear spoiler on said shell base.

12. The boot according to claim 10, wherein each helical part of said spring wound about said journal axis of said rear spoiler ends in an extreme anchoring arm extending downwardly and immobilized in a housing provided in an upper part of said rear wall of said shell base.

13. The boot according to claim 11, wherein each helical part of said spring wound about said journal axis of said rear spoiler ends in an extreme anchoring arm extending downwardly and immobilized in a housing provided in an upper part of said rear wall of said shell base.

14. The boot according to claim 12, wherein said two helical parts of said spring which are wound on said journal axis end, respectively, in extreme arms extending upwardly and extending downwardly, said two arms being substantially coplanar and resting against the external and upper surface of said rear wall of said shell base.

15. The boot according to claim 13, wherein said two helical parts of said spring which are wound on sad journal axis end, respectively, in extreme arms extending upwardly and extending downwardly, said two arms being substantially coplanar and resting against the external and upper surface of said rear wall of said shell base.

16. The boot according to claim 8, wherein said rear spoiler is journalled on said shell base, about a lower transverse axis which is positioned in front of said rear wall of said shell base and said helical parts of said spring are wound about a transverse axis which is provided on the lower part of said rear spoiler and which is used only for the mounting of said spring.

17. The boot according to claim 9, wherein said rear spoiler is journalled on said shell base, about a lower transverse axis which is positioned in front of said rear wall of said shell base and said helical parts of said spring are wound about a transverse axis which is provided on the lower part of said rear spoiler and which is used only for the mounting of said spring.

18. The boot according to claim 16, wherein said spring includes two extreme arms extending, respectively, upwardly and downwardly from said helical parts, said two extreme arms resting, when said rear spoiler is closed, against an upper and rear surface of said wall of said shell base, above a hollow provided in said upper and rear surface of said wall of said shell base.

19. The boot according to claim 17, wherein said spring includes two extreme arms extending, respectively, upwardly and downwardly from said helical parts, said two extreme arms resting, when said rear spoiler is closed, against an upper and rear surface of said wall of said shell base, above a hollow provided in said upper and rear surface of said wall of said shell base.

20. The boot according to claim 8, comprising an upper constituted by two parts journalled on said shell base about a common transverse axis, namely, a rear spoiler and a front cuff, wherein said extreme arms which extend said helical parts of said spring wound on said axis are anchored, at their ends, in portions of said cuff near said journal axis.

21. The boot according to claim 9, comprising an upper constituted by two parts journalled on said shell base about a common transverse axis, namely, a rear spoiler and a front cuff, wherein said extreme arms which extend said helical parts of said spring wound on said axis are anchored, at their ends, in portions of said cuff near said journal axis.

22. The boot according to claim 1, wherein said energy consuming device is a heating device which includes a heating assembly located in an opening of an appropriate shape provided in the upper part of the sole of said boot, said heating assembly including a burner, and wherein said energy source comprises an interchangeable gas fuel cartridge which is supported, as well as said means for controlling the gas supply, by said upper movable element of said boot.

23. An item of wearing apparel having an opening for receiving an extremity having at least two portions, one of which is movable between an open position and a closed position, directly enlarging or decreasing said opening, respectively, said item of wearing apparel further comprising:

(a) an energy source;

(b) an energy consuming device comprising a heating apparatus; and (c) means for controlling a supply of energy from said energy source to said energy consuming device comprising means for terminating said supply of energy from said energy source to said energy consuming device upon movement of said one of said two portions toward said open position.

24. The item of wearing apparel of claim 23, wherein said energy source is gaseous.

25. The item of wearing apparel of claim 24, wherein said energy source is an interchangeable gas fuel cartridge.

26. The item of wearing apparel of claim 23, wherein said item of wearing apparel is a boot and wherein said at least two portions comprise a base and a relatively movable upper.

27. The item of wearing apparel of claim 26, wherein said relatively movable upper comprises a front cuff.

28. The item of wearing apparel of claim 26, wherein said relatively movable upper comprises a rear spoiler.

29. The item of wearing apparel of claim 26, wherein said energy source and said means for controlling the supply of energy from said energy source to said energy consuming device is supported by said relatively movable upper.

30. The item of wearing apparel of claim 29, wherein said energy consuming device is a heating apparatus.

31. The item of wearing apparel of claim 23, wherein said means for controlling the supply of energy from said energy source to said energy consuming device comprises a manually actuated energy supply switch movable at least between an ON position, in which said supply of energy is permitted between said energy source and said energy consuming device, and an OFF position, in which said supply of energy is terminated from said energy source, wherein said means for controlling the supply of energy from said energy source to said energy consuming device further comprises means for linking movement of said movable portion of said item of wearing apparel to said energy switch, wherein movement of said movable portion of said item of wearing apparel toward said open position is effective to permit said energy switch to move to said OFF position.

32. The item of wearing apparel of claim 31, further comprising means for biasing said energy switch toward said OFF position and means for maintaining said energy switch in said ON position against the force of said means for biasing when said movable portion of said item of wearing apparel is in said closed position.

33. The item of wearing apparel of claim 31, wherein said item of wearing apparel is a shoe or boot and wherein said energy consuming device is a heating apparatus.

34. An item of wearing apparel having an opening for receiving an extremity comprising:

(a) at least two portion, one of said portions being movable with respect to a second of said two portions, from a first position to a second position, in a direction away from said one of said portions defining the opening in said second position which is wider than the opening defined in said first position, to facilitate the removal of an extremity from said item of wearing apparel in said second position;

(b) an energy source;

(c) an energy consuming device which is adapted to heat the apparel; and (d) means for controlling a supply of energy from said energy source to said energy consuming device comprising means for terminating said supply of energy from said energy source to said energy consuming device upon movement of said one of said two portions toward said second position.

* * * * *